US012593933B1

(12) United States Patent
Corti Maderna

(10) Patent No.: US 12,593,933 B1
(45) Date of Patent: Apr. 7, 2026

(54) FILTRATION APPARATUS AND METHOD OF USE FOR THE SAME

(71) Applicant: Sylvestre Corti Maderna, New York, NY (US)

(72) Inventor: Sylvestre Corti Maderna, New York City, NY (US)

( * ) Notice: Subject to any disclaimer, the term of this patent is extended or adjusted under 35 U.S.C. 154(b) by 28 days.

(21) Appl. No.: 18/910,620

(22) Filed: Oct. 9, 2024

(51) Int. Cl.
*A47G 21/18* (2006.01)

(52) U.S. Cl.
CPC ..... *A47G 21/188* (2013.01); *A47G 21/18* (2013.01)

(58) Field of Classification Search
CPC ... A47G 21/188; A47G 21/18; A47G 19/2272
USPC ..... 239/33; 220/706, 707, 708, 709
See application file for complete search history.

(56) References Cited

U.S. PATENT DOCUMENTS

| | | | | |
|---|---|---|---|---|
| 1,847,879 | A * | 3/1932 | Knecht | A47G 21/181 215/388 |
| 5,156,335 | A | 10/1992 | Smith et al. | |
| 7,337,705 | B1 * | 3/2008 | Catena | A47J 31/20 99/287 |
| 8,033,420 | B2 * | 10/2011 | Roseblade | A47G 19/2211 220/731 |
| 8,313,644 | B2 | 11/2012 | Harris et al. | |
| 9,005,684 | B2 | 4/2015 | Baron | |
| 2009/0140070 | A1 * | 6/2009 | Efremkin | A47G 21/18 239/33 |
| 2015/0265078 | A1 * | 9/2015 | Goosman | A47G 19/2222 220/707 |
| 2019/0261807 | A1 | 8/2019 | McLean et al. | |

FOREIGN PATENT DOCUMENTS

| | | | | |
|---|---|---|---|---|
| GB | 182901 A * | 7/1922 | | A47G 21/188 |
| GB | 190886 A * | 1/1923 | | A47G 21/188 |
| RU | 2415013 C2 | 3/2011 | | |
| WO | WO-2013163461 A1 * | 10/2013 | | A47G 19/2222 |

OTHER PUBLICATIONS

FR3088003A1 English abstract and description (Year: 2020).*

* cited by examiner

*Primary Examiner* — Reginald Alexander
(74) *Attorney, Agent, or Firm* — Brooklyn Law Incubator & Policy Clinic; Serge Krimnus

(57) ABSTRACT

An apparatus may include a cylindrical member including a primary proximal end and a primary distal end. The apparatus may include a filter comprising a secondary proximal end and a secondary distal end, a filter cavity in fluid communication with the interior cavity of the cylindrical member, and a plurality of filter passages disposed upon a surface of the filter. The apparatus may include a pressure member radially extending from, and disposed about, at least a portion of the cylindrical member. The apparatus may include the pressure member comprising a disposable material disposed across a horizontal plane of the drinking vessel, an outer downward-facing lip, and an inner downward-facing lip, configured to allow for downward pressure.

20 Claims, 8 Drawing Sheets

FILTRATION APPARATUS AND METHOD OF USE FOR THE SAME

FIELD OF INVENTION

The present disclosure is in the field of beverage filtration, specifically disposable, portable beverage filtration for loose-leaf infusions.

INTRODUCTION

Tea has achieved steady popularity in the last 5 to 10 years as an alternative to coffee as it is said to provide steady energy levels over a longer period. Among the many teas available on the market, yerba maté has gained significant popularity. This success is largely due to prominent Argentine and Uruguayan soccer players who have introduced the ritual of yerba maté to Europe. Additionally, the distinctive flavor and the steady rise in energy it provides have contributed to its widespread appeal. The steady rise in caffeine levels when drinking yerba maté, as opposed to the more extreme jolt of caffeine from coffee, are due to yerba mate's higher levels of energy-providing compounds such as L-theanine, in addition to caffeine. The ritual of steeping yerba maté tea originated in South America and traditionally involves a reusable, open-top gourd vessel with loose-leaf yerba maté tea, and a reusable metallic straw. The current steeping process requires the user to pour hot water in increments over the tea leaves which allows it to infuse with the leaves. While the leaves steep, the straw is used to press the tea leaves into the bottom and sides of the gourd, allowing for more caffeine and a more intense flavor to infuse into the hot water. The straw can then be used to drink the yerba maté tea.

This steeping style is quite labor intensive and can be cost-intensive due to the price of the gourd and metallic straw. For example, when a user first purchases a gourd, it must be "cured" which involves wetting the yerba maté leaves in the gourd, and letting it sit for up to 24 hours. The user then dumps out the mixture and scrapes the inside of the gourd, then dries the inside of the gourd with a paper towel. Additionally, the user must occasionally sanitize the gourd and straw, and the gourd and straw lack overall portability and disposability, due to the materials and construction of the open-top gourd and metallic straw.

Currently, canned, bottled, and sugar-filled yerba maté are the only disposable and portable option available for users to enjoy yerba maté tea while on-the-go, but the ability to adjust the sugar level, and the intensity of the infusion, is lacking. There is a gap in the market for a disposable, portable maté-steeping solution that allows maximum user customization as to the ratio of tea leaves to water, the steep time, and the amount of sugar added. There is also a gap in the market for a steeping solution that allows users to add water at various intervals to reuse the tea leaves over the course of the day without sacrificing portability, disposability, and labor spent sanitizing or curing a reusable gourd and straw.

SUMMARY

Aspects of the present disclosure relate to a filtration apparatus, including: a cylindrical member including a primary proximal end and a primary distal end, wherein the cylindrical member defines an interior cavity extending a length of the cylindrical member; a filter including a secondary proximal end and a secondary distal end, a filter cavity in fluid communication with the interior cavity of the cylindrical member, and a plurality of filter passages disposed upon a surface of the filter, wherein the plurality of filter passages are configured to enable separation of liquid from a particulate matter, wherein the secondary distal end is a conical shape with a closed tip; a pressure member radially extending from, and disposed about, at least a portion of the cylindrical member; the pressure member including a disposable material disposed across a horizontal plane of the drinking vessel, an outer downward-facing lip, and an inner downward-facing lip, configured to allow for downward pressure, wherein the pressure member includes a plurality of pressure passages configured to introduce liquid into the bottom of the drinking vessel.

Aspects of the present disclosure relate to a filtration apparatus, wherein the filter includes a mesh overlay disposed on the exterior surface of the filtration passages.

Aspects of the present disclosure relate to a filtration apparatus, wherein the filter includes a mesh screen disposed on the interior surface of the filter cavity, configured to cover the filtration passages.

Aspects of the present disclosure relate to a filtration apparatus, further including a mesh screen disposed on the face of the pressure member and configured to cover the pressure passages.

Aspects of the present disclosure relate to a filtration apparatus, wherein the filtration apparatus is configured to be made of any of durable paper, silicone, or plastic.

Aspects of the present disclosure relate to a filtration apparatus, wherein the filter is configured to be made of any of durable paper, silicone, or plastic.

Aspects of the present disclosure relate to a filtration apparatus, wherein the cylindrical member is configured to be made of any of durable paper, silicone, or plastic.

Aspects of the present disclosure relate to a filtration apparatus, wherein the pressure member is configured to be made of any of durable paper, silicone, or plastic.

Aspects of the present disclosure relate to a filtration apparatus, further including a lid coupled to a rim of the drinking vessel detachably affixed to the anterior shell of the primary proximal end of the cylindrical member.

Aspects of the present disclosure relate to a filtration apparatus, further including a mouthpiece coupled to the primary proximal end of the cylindrical member, the mouthpiece including planar surfaces and a top opening.

Aspects of the present disclosure relate to a filtration apparatus, wherein the plurality of pressure passages has an opening area range of 2 mm2 to 10 mm2.

Aspects of the present disclosure relate to a filtration apparatus, wherein the plurality of filter passages has an opening area range of 1 mm2 to 3 mm2.

Aspects of the present disclosure relate to a filtration apparatus, wherein the primary distal end of the cylindrical member is configured to insert into a drinking vessel.

Aspects of the present disclosure relate to a filtration apparatus, wherein the filter is coupled to the cylindrical member via an interference fit such that a projection from the primary distal end of the cylindrical member interlocks with a complementary recess located on the secondary proximal end of the filter.

Aspects of the present disclosure relate to a filtration apparatus, wherein the secondary distal end is a conical shape with a closed tip configured to reach the bottom of a drinking vessel.

Aspects of the present disclosure relate to a filtration apparatus, wherein the inner lip of the pressure member is retained about the filter via an interference fit such that an upper protuberance and lower protuberances disposed on the outside of the filter above the filtration passages define a recess that is complementary to the inner lip of the pressure member.

Aspects of the present disclosure relate to a method of infusing and filtering a liquid, including the steps of: adding leaves or grounds into the bottom of a drinking vessel; inserting the filtration apparatus into the drinking vessel; pouring a liquid into the drinking vessel, wherein the liquid travels through the pressure passages into the leaves or grounds at the bottom of the drinking vessel, becoming an infused liquid; exerting downward pressure, via the pressure member, on the leaves or grounds and the infused liquid in the drinking vessel; creating a vacuum, via user contact with the mouthpiece, wherein the vacuum causes the infused liquid to travel through a plurality of filter passages, into the filtration cavity, and up the cylindrical member; separating the infused liquid from the leaves or grounds via the plurality of filter passages, wherein the filter passages allow the infused liquid to travel into the filter cavity while retaining the leaves or grounds within the bottom of the drinking vessel.

Aspects of the present disclosure relate to a method, wherein a vacuum is created via user contact with the primary proximal end on the cylindrical member.

Aspects of the present disclosure relate to a method, wherein separating the infused liquid from the leaves or grounds occurs via a mesh screen on the filter passages.

Aspects of the present disclosure relate to a method, further including the step of adding ice or flavoring into the drinking vessel.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

Figure 1:
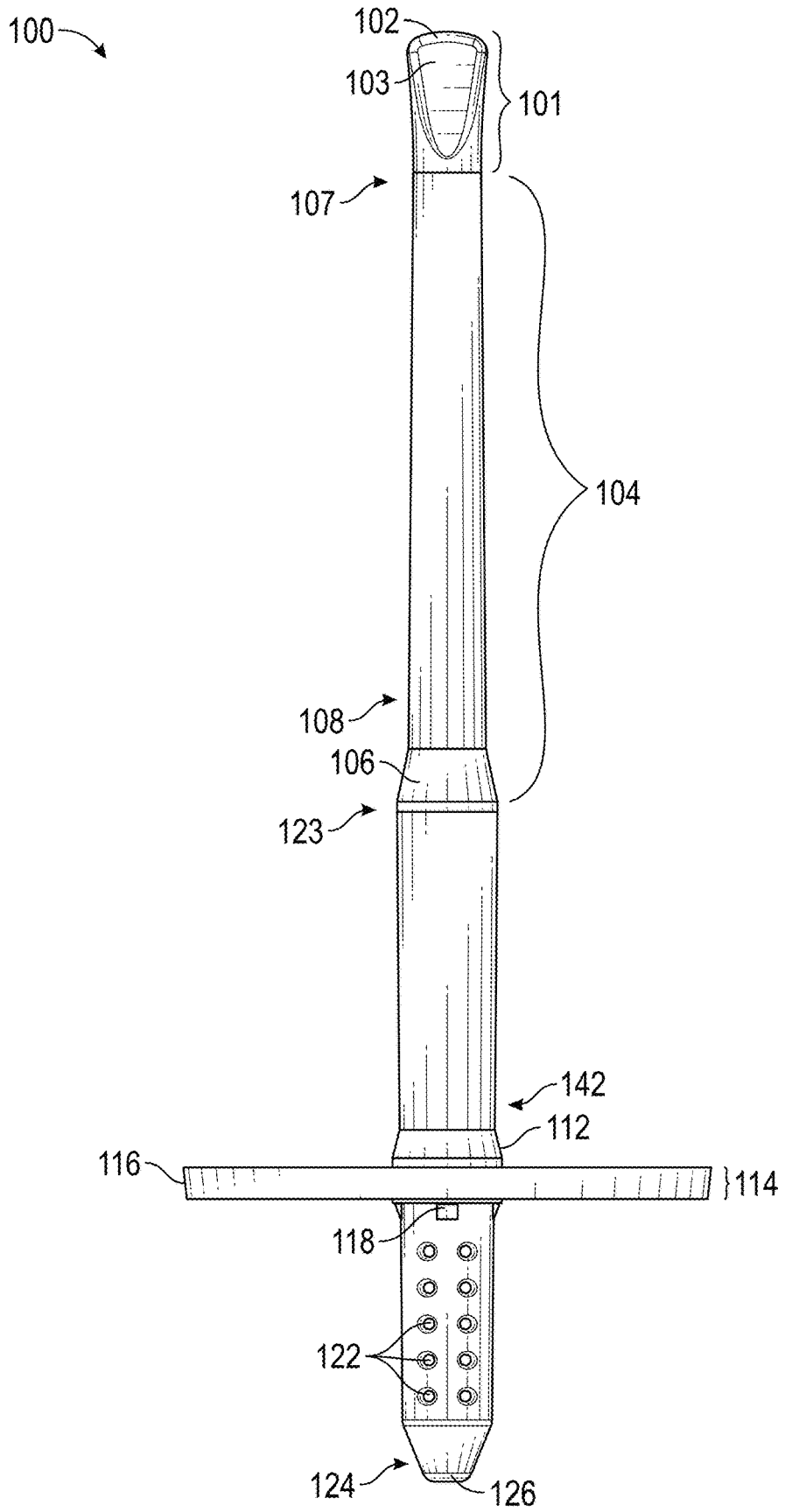
FIG. 1 illustrates a front view of the filtration apparatus according to an embodiment of the present invention.
Figure 2A:
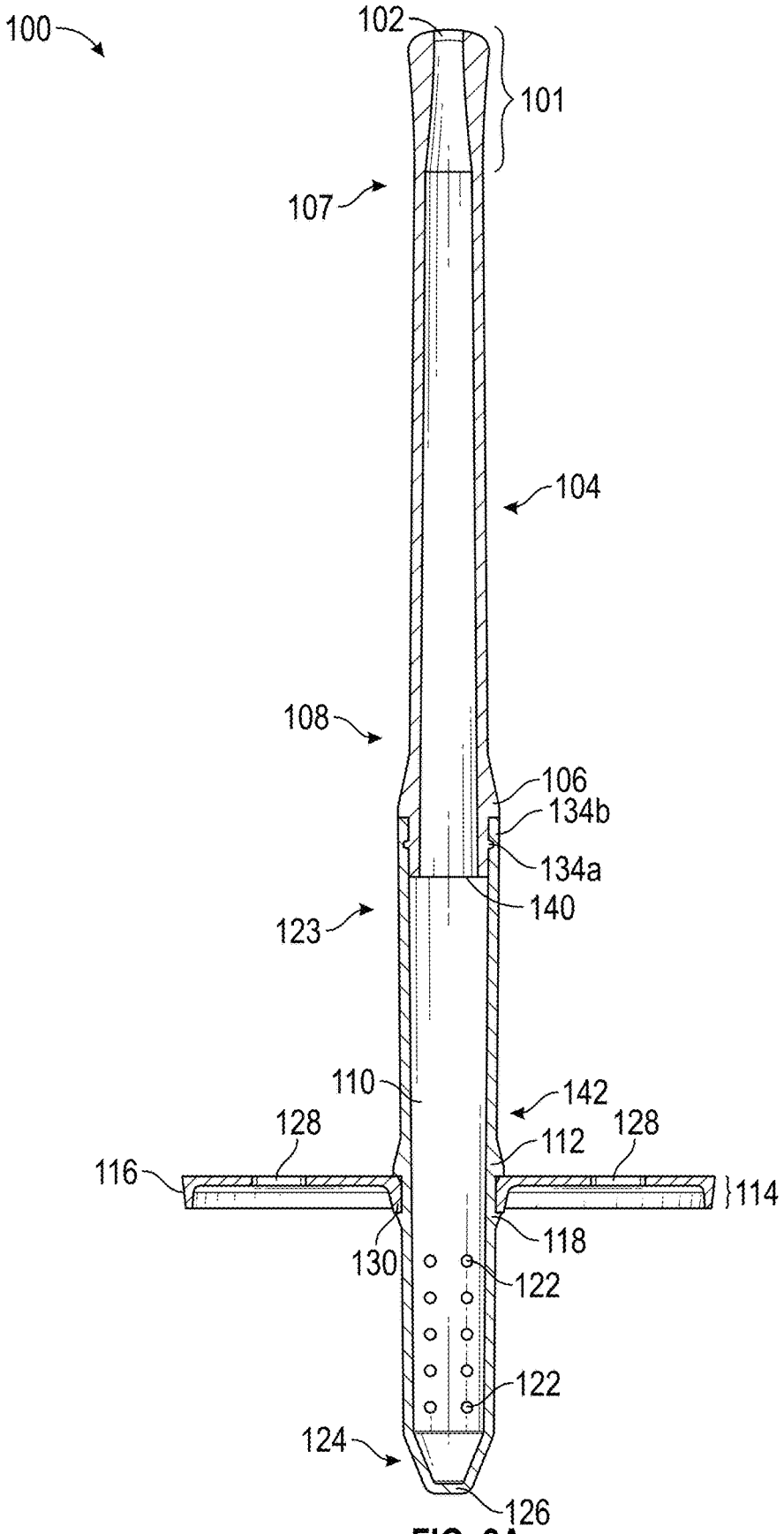
FIG. 2*a* illustrates a from, bisected view of the filtration apparatus of FIG. 1.

As illustrated in FIGS. 1 and 2*a*, an embodiment of a filtration apparatus 100 may comprise a mouthpiece 101, a cylindrical member 104, a filter 142, and a pressure member 114. In one embodiment, the filtration apparatus 100 may be created via a plastic injection mold, sealing the mouthpiece 101, cylindrical member 104, filter 142, and pressure member 114 together with plastic. In another embodiment, the filter 142, pressure member 114, cylindrical member 104, and mouthpiece 101 may be manufactured separately and coupled together during assembly via a water-tight interference fit, or other water-tight connection methods readily available to someone having ordinary skill in the art. In an additional embodiment, the filtration apparatus 100 may be made of stainless steel or similar metals known to someone having ordinary skill in the art, via metal casting. In a further embodiment, the filter 142, pressure member 114, cylindrical member 104, and mouthpiece 101 may be manufactured separately via metal casting and coupled together during assembly via a water-tight interference fit, or other water-tight connection methods readily available to someone having ordinary skill in the art. The connections between the mouthpiece 101, cylindrical member 104, filter 142, and pressure member 114 may be secured with food-safe bonding agents or adhesives.

The mouthpiece 101 may include a top opening 102 and planar surfaces 103 on each side for the user to make contact. The planar surfaces 103 allow the liquid to cool slightly as it travels through the mouthpiece 101, helps regulate the flow of liquid through the mouthpiece 101, and improves overall user experience as it is adapted to better fit the lips of the user. The mouthpiece 101 may be affixed to the primary proximal end 107 of the cylindrical member 104.

The primary distal end 108 on the cylindrical member 104 may have a projection 134*a* that is configured to fit into a complementary recess 134*b* on the secondary proximal end 123 on the filter 142 to create an interference fit. The primary distal end 108 of the cylindrical member 104 may have a gradually thicker cylinder wall 106 before the interference fit, configured to allow the projection 134*a* on the primary distal end 108 of the cylindrical member 104 to enter the complementary recess 134*b* on the secondary proximal end 123 of the filter 142 while allowing for a smooth connection point between the filter 142 and the cylindrical member 104.

The filter opening 140 at the secondary proximal end 123 on the filter 142 is configured to allow liquid to flow from the filter cavity 110 up through the cylindrical member 104. The filter opening 140 can be configured to allow the liquid to flow from the cylindrical member 104, up through the mouthpiece 101 and out the mouthpiece opening 102. The diameter of the filter 142 can be larger than the diameter of the cylindrical member 104.

The pressure member 114 may be disposed at the midpoint between the secondary proximal end 123 and secondary distal end 124 and may be configured to be retained between an upper protuberance 112 and a lower protuberances 118 on the filter 142. In an additional embodiment, the pressure member 114 may be disposed anywhere along the outside of the filter 142 above the plurality of filter passages 122 and retained by the upper protuberance 112 and lower protuberances 118 anywhere along the outside of the filter 142 above the plurality of filter passages 122. In one embodiment, the upper protuberance 112 is configured to protrude around the entire circumference of the filter 142 above the pressure member 114. In another embodiment, the upper protuberance 112 can be divided into a plurality of shorter upper protuberances adequately spaced to retain the pressure member 114. In one embodiment, the lower protuberances 118 are configured to protrude around the entire circumference of the filter 142 below the pressure member 114. In another embodiment, the lower protuberances 118 can be joined into one lower protuberance around the entire circumference of the filter 142.

The plurality of filter passages 122 may be disposed along one side of the filter 142 below the pressure member 114. In an additional embodiment, the plurality of filter passages 122 can be disposed along all sides of the filter 142 below the pressure member 114.

In one embodiment, a disposable lid may have an aperture for insertion of the cylindrical member 104 allowing the cylindrical member 104 to be detachably affixed to the disposable lid. The aperture may be configured to be an adequate size to allow for a secure and leak-resistant connection around the circumference of the cylindrical member 104. The disposable lid may then be coupled to the rim of the opening of a drinking vessel to create a spill-resistant drinking vessel.

Figure 2B:
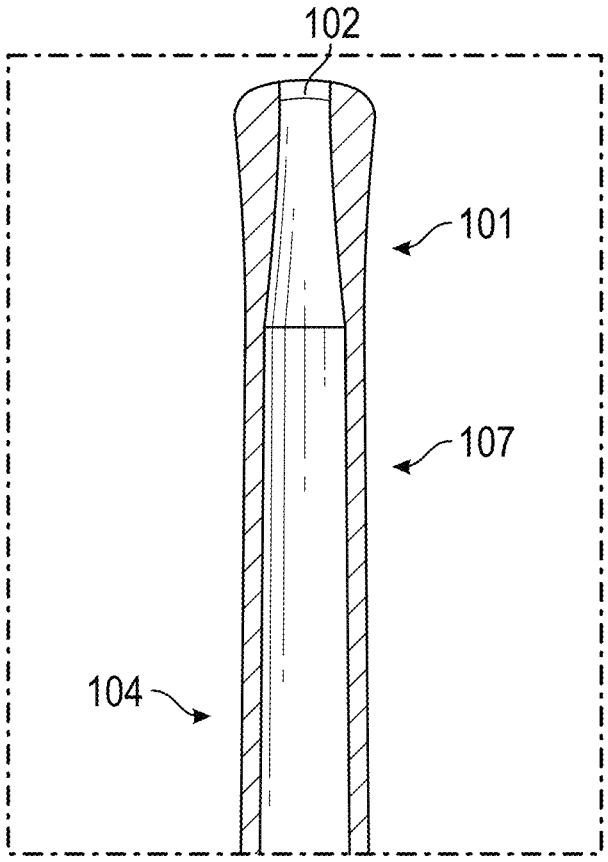
FIG. 2*b* illustrates an exploded, bisected view of the mouthpiece coupled to the cylindrical member.

As shown in FIG. 2*b*, the mouthpiece 101 may comprise a top opening 102 configured to have a substantially narrower diameter than the cylindrical member 104. The mouthpiece 101 may have a tapering diameter in which the diameter of the mouthpiece 101 at the connection point with the cylindrical member 104 may be equivalent to the diameter of the cylindrical member 104, then the diameter of the mouthpiece 101 may gradually reduce to a smaller diameter near the top opening 102. In an additional embodiment, the mouthpiece opening 102 may have diameter equivalent to the diameter of the cylindrical member 104.

Figure 3:
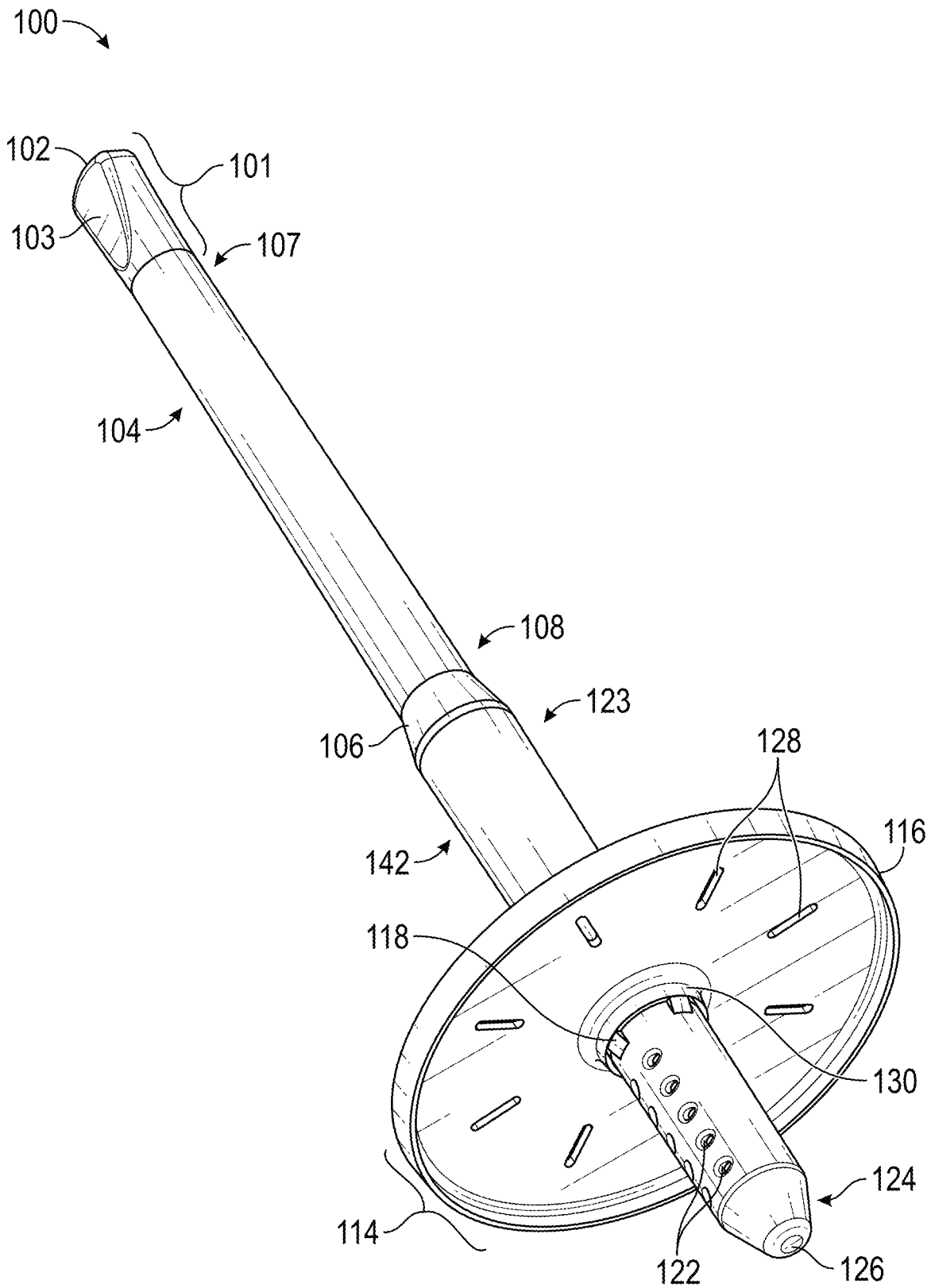
FIG. 3 illustrates a side, lower perspective view of the filtration apparatus showing the pressure passages in the pressure module.

As illustrated in FIG. 3, the closed secondary distal end 124 on the filter 142 may have a conical shape configured to taper to a narrow, closed tip 126 which may be configured to touch the bottom of a drinking vessel. In an additional embodiment, the diameter of the tip 126 may be equivalent to the diameter of the filtration cavity 110. In a further embodiment, the diameter of the tip 126 may be substantially larger than the diameter of the filtration cavity 110.

In one embodiment, the pressure member 114 may have an outer lip 116 and an inner lip 130 to facilitate the downward pressure on leaves or grounds within a drinking vessel, while minimizing the amount of leaves or grounds that can escape the bottom of the drinking vessel. The outer lip 116 and inner lip 130 may be substantially thicker near the face of the pressure member 114 and taper downward to a thin end pointing toward the bottom of the drinking vessel.

The pressure member 114 may be configured to be the shape of a horizontal cross-section of a drinking vessel. In an additional embodiment, the pressure member 114 may be one of a variety of suitable shapes or sizes that allow the pressure member 114 to enter a drinking vessel without allowing leaves or grounds to pass between the outer lip 116 and the wall of the drinking vessel.

In one embodiment, the plurality of pressure passages 128 may be disposed along the face of the pressure member 114. The plurality of pressure passages 128 may have an opening area range of 2 $mm^2$ to 10 $mm^2$. A preferred embodiment may have an oval or ellipse shape with an opening area of 7 $mm^2$. In an additional embodiment, the plurality of pressure passages 128 may have a circular shape, square shape, or any other suitable shape known by a person having ordinary skill in the art to allow liquid to enter the bottom of a drinking vessel, while keeping downward pressure on leaves or grounds, and preventing leaves or grounds from escaping the bottom of the drinking vessel.

Figure 4:
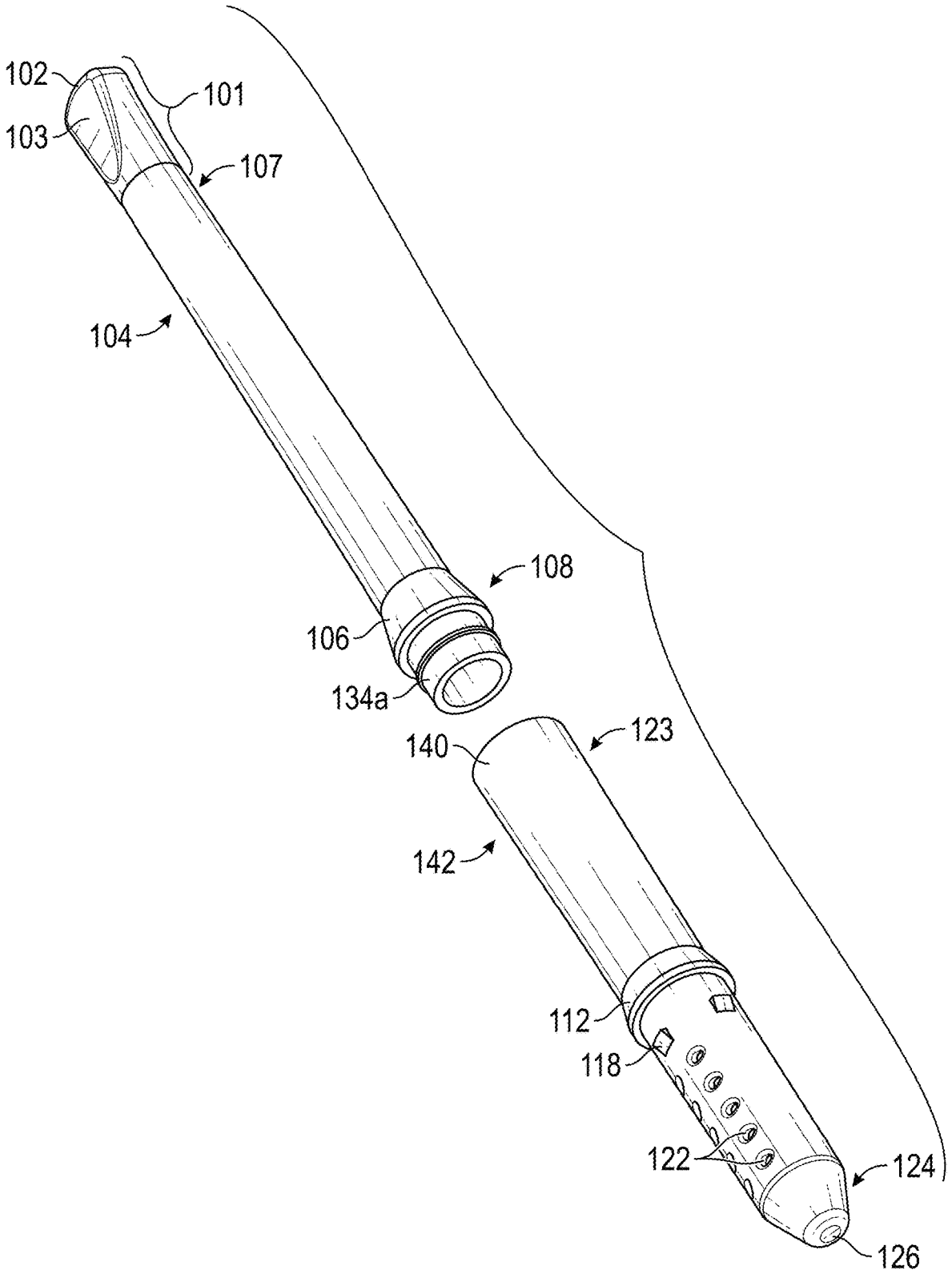
FIG. 4 illustrates a side, lower perspective view of the filtration apparatus without the pressure module, further showing the connectivity between the components.

FIG. 4 further illustrates the connection between the cylindrical member 104 and the filter 142. The primary distal end 108 on the cylindrical member 104 may have a projection 134*a* configured to fit into a complementary recess 134*b* in the filter opening 140 on the secondary proximal end 123 on the filter 142 to create an interference fit. In one embodiment, the projection 134*a* may be disposed around the circumference of the primary distal end 108 on the cylindrical member 104. In another embodiment, the projection 134*a* can be segmented into a plurality of projections around the circumference of the primary distal end 108 on the cylindrical member 104. This plurality of projections may be adequately spaced to allow engagement of the interference fit. The primary distal end 108 on the cylindrical member 104 may have a gradually wider cylinder wall 106 before the interference fit, configured to allow a smooth connection point between the filter 142 and the cylindrical member 104. The filter opening 140 at the secondary proximal end 123 may be configured to allow liquid to flow from the filter cavity 110 up through the cylindrical member 104.

In one embodiment, the filter 142 may be substantially wider than the cylindrical member 104 to allow the filter cavity 110 to hold more infused liquid while the plurality of filter passages 122 separate the infused liquid from the loose leaves or grounds. As a non-limiting example, the length of the filter 142 from the tip 126 to the filter opening 140 may be adequately sized to reach the bottom of the drinking vessel while allowing space for an amount of leaves or grounds ranging from 5 g to 35 g of leaves or grounds. As a non-limiting example, the length of the filter 142 from the tip 126 to the filter opening 140 may be a range from 25 mm to 150 mm in length. In another embodiment, the amount of leaves or grounds may be any amount understood by a person with ordinary skill in the art to provide adequate infusion with liquid or chosen by the user based on factors such as desired intensity of the infused liquid and desired number of re-steeping actions.

Figure 5A:
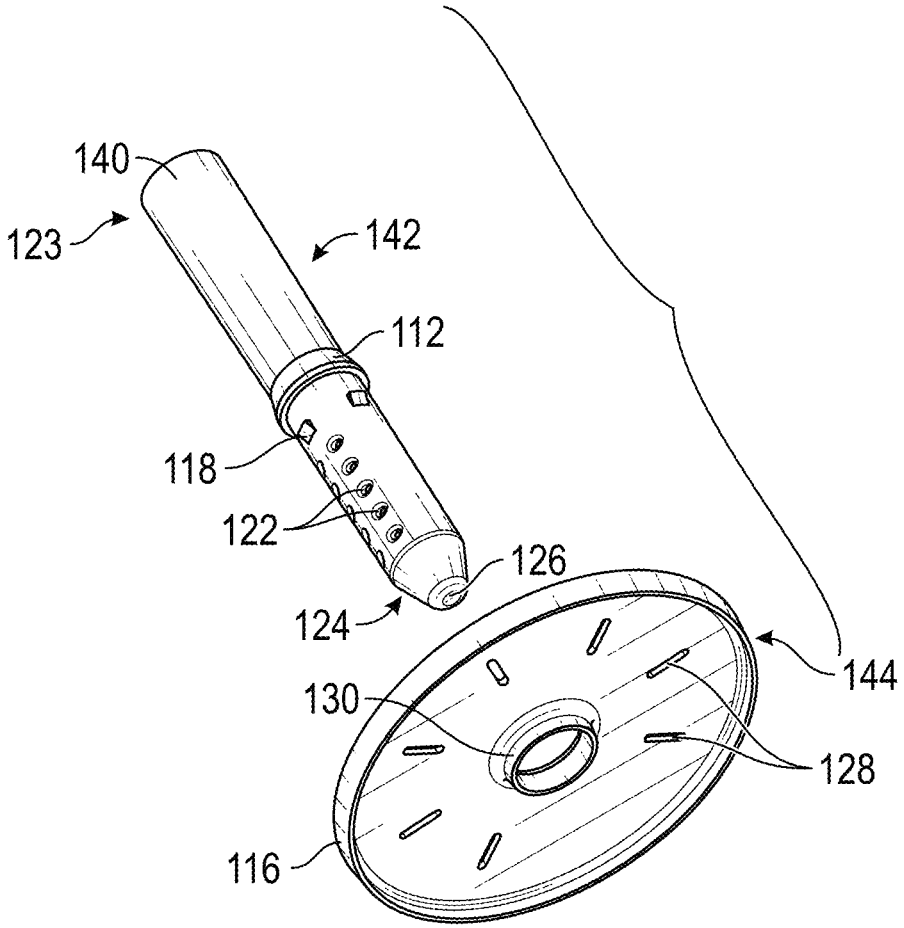
FIG. 5*a* illustrates an exploded, lower perspective view of the filter and pressure member.
Figure 5B:
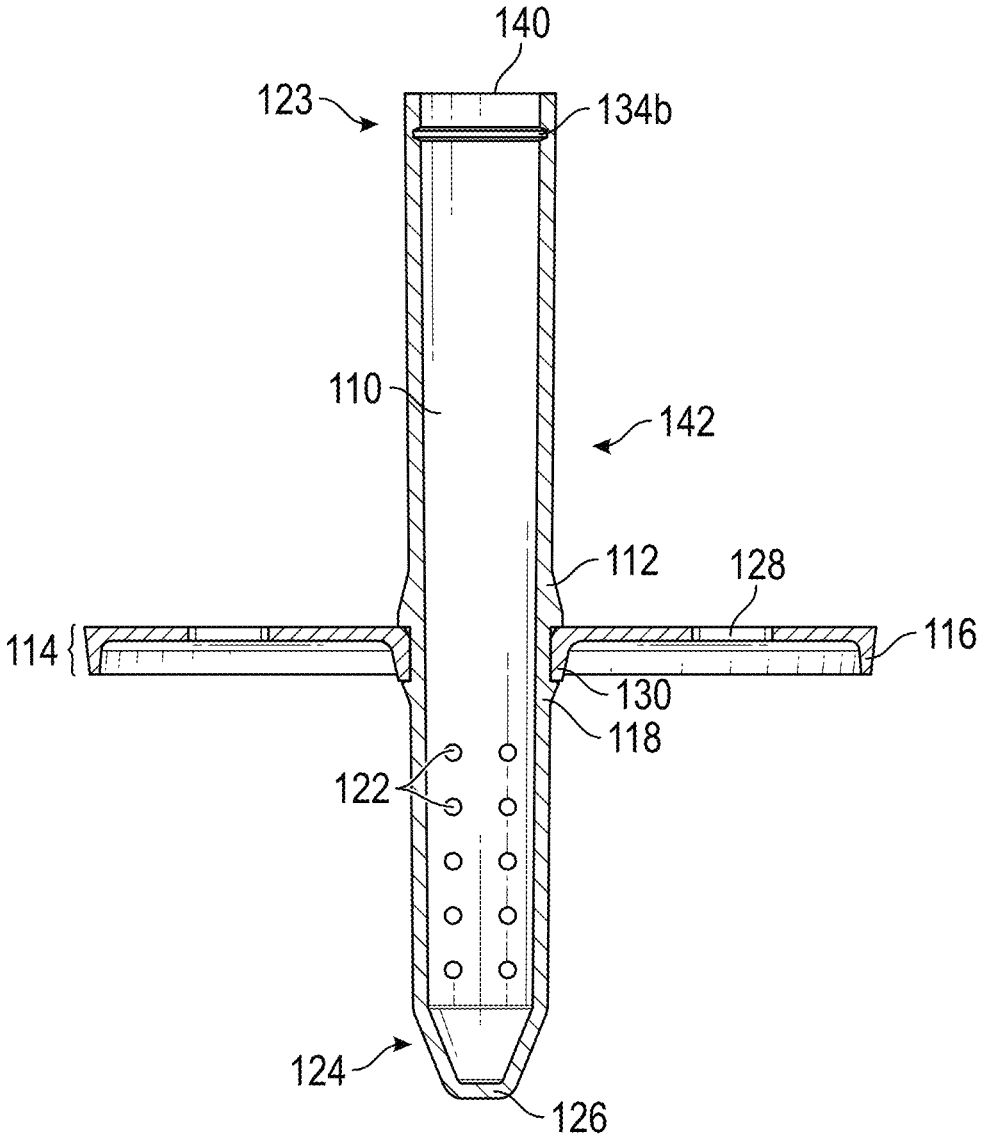
FIG. 5*b* illustrates an exploded, bisected side view of the filter coupled to the pressure member.

FIGS. 5*a* and 5*b* further illustrate the filter 142 and pressure member 114. FIG. 5*a* illustrates the filter 142 and pressure member 114 separated, without engagement of the upper protuberance 112 and lower protuberances 118 in retaining the inner lip 130 of the pressure member 114. FIG. 5*b* illustrates the upper protuberance 112 and lower protuberances 118 retaining the inner lip 130 of the pressure member 114 disposed at the midpoint of the filter 142. FIG. 5*b* further illustrates the complementary recess 134*b* configured to accept the projection 134*a* on the primary distal end 108 of the cylindrical member 104. In one embodiment, the filter 142 may include a mesh screen installed over the plurality of filter passages 122 to allow for separation of the infused liquid from smaller leaves, grounds, or other particulate matter. The mesh screen may be installed within the filter cavity 110 to cover the plurality of filtration passages 122. The plurality of filter passages 122 may have an opening area range of 1 $mm^2$ to 3 $mm^2$ and a preferred embodiment can have an opening area of 2 $mm^2$. The plurality of filter passages 122 may be circular, oval, square, or any other suitable shape known by a person having ordinary skill in the art to block the particulate matter from entering the filter 142, while allowing the infused liquid to travel through the plurality of filter passages 122 and up through the cylindrical member 104.

Figure 6:
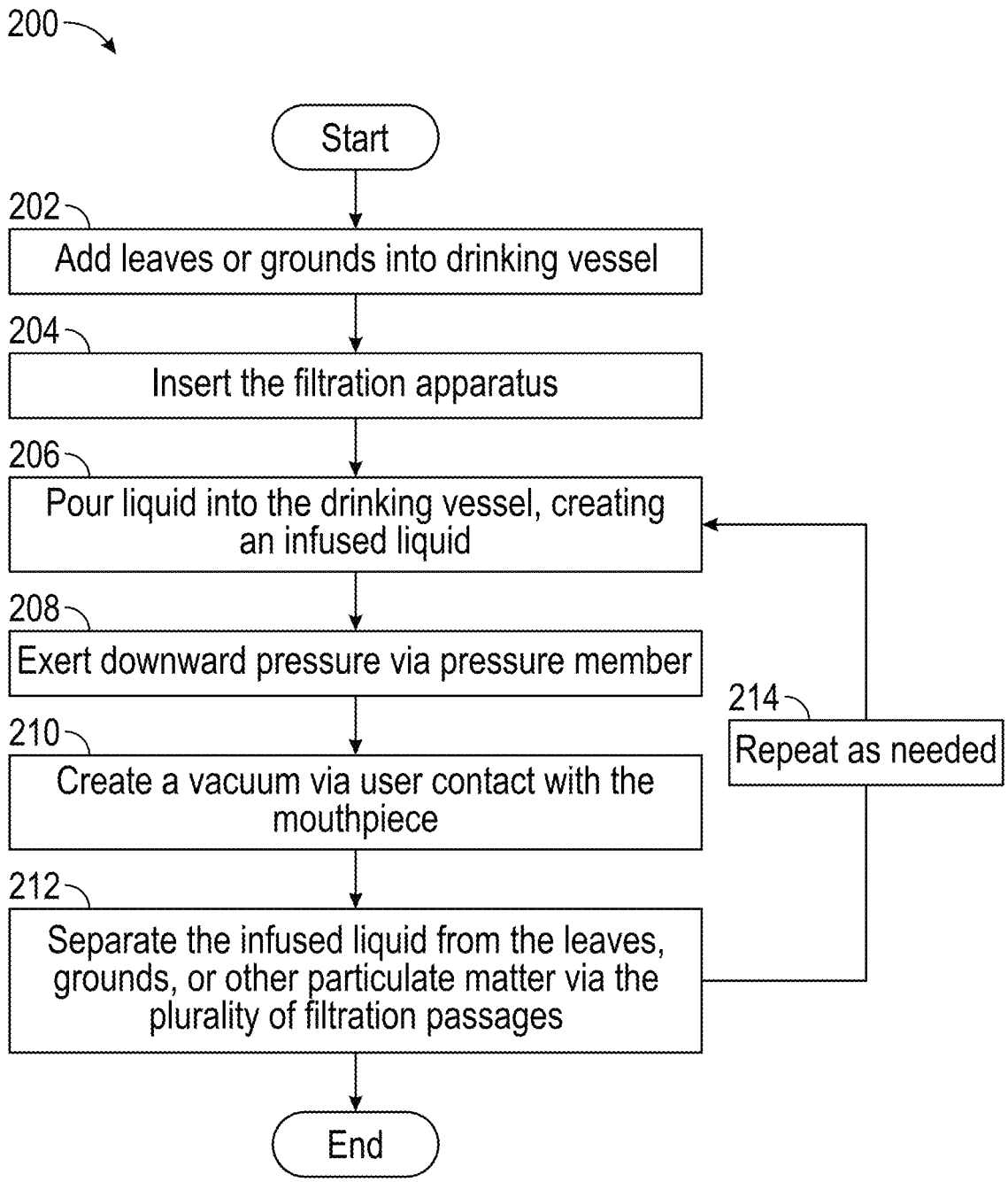
FIG. 6 illustrates a method for using the filtration apparatus to infuse and filter liquid.

FIG. 6 exemplifies a method 200 of how the filtration apparatus as described herein may be used including the steps of adding leaves or grounds to the bottom of a drinking vessel 202, inserting 204 the filtration apparatus 100, with the closed tip 126 angled toward the bottom of the drinking vessel, then pouring a liquid into the drinking vessel 206, where the liquid will subsequently travel through the pressure passages 128 to the leaves or grounds at the bottom of the drinking vessel. The user then may exert downward pressure 208 on the leaves or grounds via the pressure member 114 to create a stronger and more flavorful infused liquid. The user may then make contact with the mouthpiece 100 and create a vacuum 210, causing the infused liquid to travel through the filter passages 122. The filter passages 122 may separate the infused liquid from the leaves, grounds, or other particulate matter 212, by allowing the infused liquid to travel into the filter cavity 110 while keeping the leaves, grounds or other particulate matter within the bottom of the drinking vessel. The infused liquid may then travel up the filter cavity 110 and up through the cylindrical member 104.

In one embodiment, the infused liquid may then travel through the mouthpiece 101 and out the mouthpiece opening 102 to be enjoyed by the user. In an additional embodiment, the infused liquid can travel out the primary proximal end 107 to be enjoyed by the user. As a further embodiment, the method may include exerting diagonal, angular pressure on the leaves or grounds via the pressure member, rather than strictly downward pressure. The method may include repeating as necessary 214 the steps of pouring liquid into the drinking vessel 206, exerting downward pressure via the pressure member 208, creating a vacuum via user contact with the mouthpiece 210, and separating the infused liquid from the leaves or grounds via the plurality of filtration passages 212, allowing for re-steeping or re-infusion of the leaves or grounds in the drinking vessel.

All aforementioned steps may be carried out in another order contemplated by a person having ordinary skill in the art. As a non-limiting example, the method may include the steps of adding leaves or grounds into the drinking vessel 202, pouring liquid into the drinking vessel 206, then inserting the filtration apparatus 204, exerting downward pressure 208 on the leaves or grounds within the drinking vessel, creating a vacuum via user contact with the mouthpiece 210, and separating the infused liquid from the grounds or leaves via the filtration passages 212. As another non-limiting example, the method may include an additional step of adding ice or flavoring, at any time during the use of the filtration apparatus. As another non-limiting example, the method may include the steps of pouring liquid into the drinking vessel 206, adding the leaves or grounds 202, then inserting the filtration apparatus 204, exerting downward pressure via the pressure member 208, creating a vacuum via user contact with the mouthpiece 210, and separating the infused liquid from the leaves or grounds via the plurality of filter passages 212.

What is claimed is:

1. A filtration apparatus, comprising:

a cylindrical member including a primary proximal end and a primary distal end, wherein the cylindrical member defines an interior cavity extending a length of the cylindrical member;

a filter comprising a secondary proximal end and a secondary distal end, a filter cavity in fluid communication with the interior cavity of the cylindrical member, and a plurality of filter passages disposed upon a surface of the filter, wherein the plurality filter passages are configured to enable separation of liquid from a particulate matter, wherein the secondary distal end is a conical shape with a closed tip;

a pressure member radially extending from, and disposed about, at least a portion of the cylindrical member;

the pressure member comprising a disposable material disposed across a horizontal plane of a drinking vessel, an outer downward-facing lip, and an inner downward-facing lip, configured to allow for downward pressure, wherein the pressure member includes a plurality of pressure passages configured to introduce liquid into a bottom of the drinking vessel.

2. The filtration apparatus of claim 1, wherein the filter includes a mesh overlay disposed on an exterior surface of the filtration passages.

3. The filtration apparatus of claim 1, wherein the filter includes a mesh screen disposed on the interior surface of the filter cavity, configured to cover the filtration passages.

4. The filtration apparatus of claim 2, further including a mesh screen disposed on a face of the pressure member and configured to cover the pressure passages.

5. The filtration apparatus of claim 1, wherein the filtration apparatus is configured to be made of any of durable paper, silicone, or plastic.

6. The filtration apparatus of claim 1, wherein the filter is configured to be made of any of durable paper, silicone, or plastic.

7. The filtration apparatus of claim 1, wherein the cylindrical member is configured to be made of any of durable paper, silicone, or plastic.

8. The filtration apparatus of claim 1, wherein the pressure member is configured to be made of any of durable paper, silicone, or plastic.

9. The filtration apparatus of claim 1, further comprising a lid coupled to a rim of the drinking vessel detachably affixed to an anterior shell of the primary proximal end of the cylindrical member.

10. The filtration apparatus of claim 1, further comprising a mouthpiece coupled to the primary proximal end of the cylindrical member, the mouthpiece comprising planar surfaces and a top opening.

11. The filtration apparatus of claim 1, wherein the plurality of pressure passages has an opening area range of 2 $mm^2$ to 10 $mm^2$.

12. The filtration apparatus of claim 1, wherein the plurality of filter passages has an opening area range of 1 $mm^2$ to 3 $mm^2$.

13. The filtration apparatus of claim 1, wherein the primary distal end of the cylindrical member is configured to insert into a drinking vessel.

14. The filtration apparatus of claim 1, wherein the filter is coupled to the cylindrical member via an interference fit such that a projection from the primary distal end of the cylindrical member interlocks with a complementary recess located on the secondary proximal end of the filter.

15. The filtration apparatus of claim 1, wherein the secondary distal end is a conical shape with a closed tip configured to reach the bottom of a drinking vessel.

16. The filtration apparatus of claim 1, wherein the inner lip of the pressure member is retained about the filter via an interference fit such that an upper protuberance and lower protuberances disposed on an outside of the filter above the filtration passages define a recess that is complementary to the inner lip of the pressure member.

17. A method of using the filtration apparatus of claim 1, comprising the steps of:

adding leaves or grounds into the bottom of the drinking vessel;

inserting the filtration apparatus into the drinking vessel;

pouring the liquid into the drinking vessel, wherein the liquid travels through the pressure passages into the leaves or grounds at the bottom of the drinking vessel, becoming an infused liquid;

exerting downward pressure, via the pressure member, on the leaves or grounds and the infused liquid in the drinking vessel;

creating a vacuum, via user contact with a mouthpiece, wherein the vacuum causes the infused liquid to travel through the plurality of filter passages, into the filtration cavity, and up the cylindrical member;

separating the infused liquid from the leaves or grounds via the plurality of filter passages, wherein the filter passages allow the infused liquid to travel into the filter cavity while retaining the leaves or grounds within the bottom of the drinking vessel.

18. The method of claim 17, wherein a vacuum is created via user contact with the primary proximal end on the cylindrical member.

19. The method of claim 17, wherein separating the infused liquid from the leaves or grounds occurs via a mesh screen on the filter passages.

20. The method of claim 17, further comprising the step of adding ice or flavoring.

* * * * *